US007114349B2

(12) United States Patent
Lifson et al.

(10) Patent No.: US 7,114,349 B2
(45) Date of Patent: Oct. 3, 2006

(54) REFRIGERANT SYSTEM WITH COMMON ECONOMIZER AND LIQUID-SUCTION HEAT EXCHANGER

(75) Inventors: Alexander Lifson, Manlius, NY (US); Michael F. Taras, Fayetteville, NY (US); Howard H. Fraser, Jr., New Woodstock, NY (US); Russell G. Lewis, Manlius, NY (US); Andre Stumpf, Bonsecours (FR)

(73) Assignee: Carrier Corporation, Syracuse, NY (US)

( * ) Notice: Subject to any disclaimer, the term of this patent is extended or adjusted under 35 U.S.C. 154(b) by 80 days.

(21) Appl. No.: 11/010,039

(22) Filed: Dec. 10, 2004

(65) Prior Publication Data

US 2006/0123840 A1 Jun. 15, 2006

(51) Int. Cl.
*F25B 41/00* (2006.01)
*F25B 49/00* (2006.01)

(52) U.S. Cl. ..... 62/513; 62/113; 62/196.2

(58) Field of Classification Search ..... 62/113, 62/196.2, 513
See application file for complete search history.

(56) References Cited

U.S. PATENT DOCUMENTS 5,996,364 A 12/1999 Lifson
6,058,729 A * 5/2000 Lifson et al. ..... 62/217
6,474,087 B1 * 11/2002 Lifson ..... 62/199

* cited by examiner

*Primary Examiner*—Cheryl Tyler
*Assistant Examiner*—B. Clayton McCraw
(74) *Attorney, Agent, or Firm*—Carlson, Gaskey & Olds

(57) ABSTRACT

A refrigerant system is provided where the functions of an economizer heat exchanger and liquid-suction heat exchanger are combined. The two configurations are disclosed with a single common heat exchanger construction. In a first configuration, a series of valves selectively routes only one of two possible refrigerant flows through a common heat exchanger such that a control can selectively activate either an economizer heat exchanger circuit or a liquid-suction heat exchanger function. In a second configuration, both refrigerant flows are passed to the common heat exchanger through separate fluid lines and are selectively activated by the control. Variations of the second configuration are also disclosed.

18 Claims, 2 Drawing Sheets

REFRIGERANT SYSTEM WITH COMMON ECONOMIZER AND LIQUID-SUCTION HEAT EXCHANGER

BACKGROUND OF THE INVENTION

This invention relates to a refrigerant system that incorporates an economizer heat exchanger and liquid-suction heat exchanger within a single common heat exchanger construction.

Refrigerant systems are utilized in applications to change the temperature and humidity or otherwise condition the environment. In a standard refrigerant system, a compressor delivers a compressed refrigerant to an outdoor heat exchanger, known as a condenser. From the condenser, the refrigerant passes through an expansion device, and then to an indoor heat exchanger, known as an evaporator. In the evaporator, moisture may be removed from the air, and the temperature of air blown over the evaporator coil is lowered. From the evaporator, the refrigerant returns to the compressor. Of course, basic refrigerant systems are utilized in combination with many configuration variations and optional features. However, the above provides a brief understanding of the fundamental concept.

An enhancement technique known as an economizer cycle has been utilized in refrigerant systems. The economizer circuit increases the capacity and efficiency of a refrigerant system. When the economizer circuit is functioning, a refrigerant is tapped from a main liquid refrigerant line at the position downstream of the condenser. This tapped refrigerant is expanded to a lower pressure and temperature and then passed through a heat exchanger where it exchanges heat to cool the main refrigerant flow. This tapped refrigerant is then returned to the compressor through the intermediate compression port. The main refrigerant flow having been cooled in the economizer heat exchanger has a greater cooling capacity when it reaches the evaporator.

Another way to increase refrigerant system performance is to use a liquid-suction heat exchanger. In such an arrangement, refrigerant downstream of the evaporator is passed through a heat exchanger where it subcools liquid refrigerant flowing from the condenser to the expansion device. This scheme provides additional cooling capacity when the refrigerant reaches the evaporator, but at the expense of having higher temperature and lower density refrigerant reaching the compressor.

The use of the economizer heat exchanger option would provide the most benefits under some operating conditions, while the use of the liquid-suction heat exchanger would provide the most benefits under other operating conditions. In the past, the designer had to choose between using either one option or the other. Providing both options has been expensive and somewhat cumbersome as two separate heat exchangers were required.

SUMMARY OF THE INVENTION

In the disclosed embodiment of this invention, the functions of the economizer heat exchanger and liquid-suction heat exchanger are provided within a refrigerant system, utilizing a single common heat exchanger construction. In a first schematic, a tap downstream of the condenser provides two refrigerant flows through a common heat exchanger. Another tap downstream of the evaporator selectively routes the refrigerant through the same common heat exchanger. A plurality of flow control devices such as valves are placed across the system to allow control and proper routing of refrigerant flow in various modes of operation. By selectively opening and closing these valves, the system can provide an economizer function, or the liquid-suction heat exchanger function, utilizing a single, common heat exchanger construction.

In a second schematic, the refrigerant downstream of the evaporator always passes through a common heat exchanger to provide the liquid-suction heat exchanger function. The economizer function is achieved selectively by activating an economizer circuit to pass tapped refrigerant through the common heat exchanger. In another variation of the second schematic, a bypass can allow at least a portion of refrigerant downstream of the evaporator to bypass this common heat exchanger, thus effectively disengaging a liquid-suction heat exchanger section (partially or entirely) from the active refrigerant circuit. In yet another variation of the second schematic, a flow control device selectively routes the refrigerant to a liquid-suction heat exchanger, or directly to the evaporator, while an economizer function and a liquid-suction heat exchanger function may be provided by separate units.

These and other features of the present invention can be best understood from the following specification and drawings, the following of which is a brief description.

DETAILED DESCRIPTION OF THE PREFERRED EMBODIMENT

Figure 1:
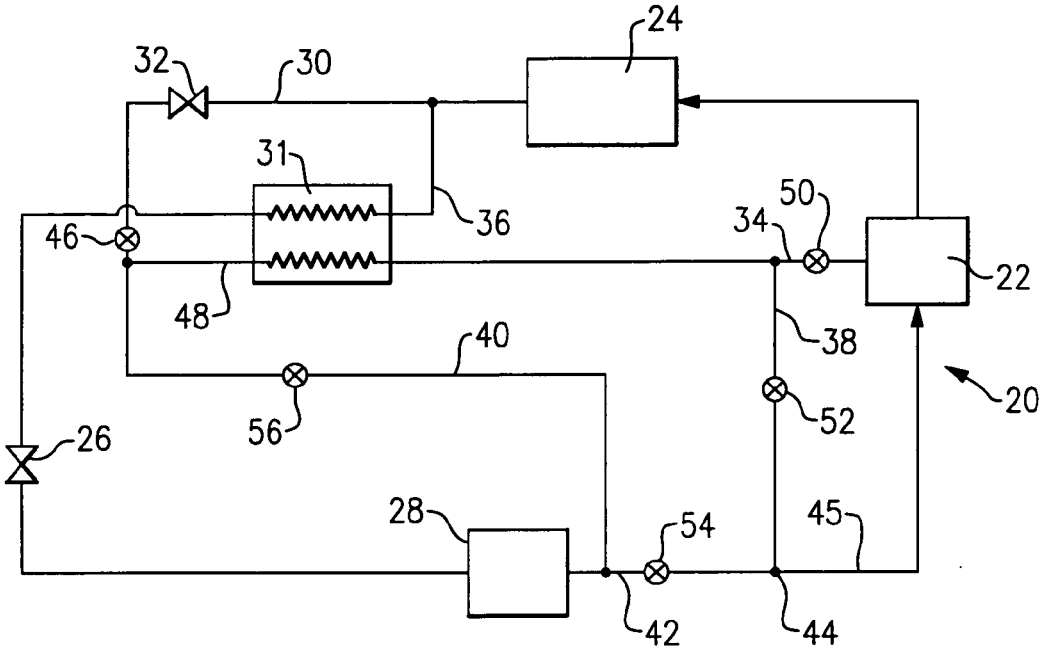
FIG. 1 is a first schematic of the present invention.

A refrigerant system 20 is illustrated in FIG. 1, having a compressor 22 compressing refrigerant and delivering it downstream to a condenser 24. An expansion device 26 is positioned downstream of condenser 24, and an evaporator 28 is located downstream of the expansion device 26. An economizer tap 30 taps a portion of refrigerant through an economizer expansion device 32, and then through a common heat exchanger 31. Refrigerant also passes through the common heat exchanger 31 from a main liquid refrigerant line 36 downstream of the condenser 24. A supply line 48 delivers refrigerant from tap 30 through the common heat exchanger 31 when a valve 46 is open. Thus, to provide an economizer function, refrigerant passes through the economizer expansion device 32, and through the opened valve 46 into the common heat exchanger 31. It should be noted that the valve 46 may not be needed in case the economizer expansion device 32 can be controlled to an entirely closed position.

Another tap 40 is tapped from a point 42 downstream of the evaporator 28. The tap 40 also communicates with the supply line 48 passing through the common heat exchanger 31. A valve 54 downstream of the evaporator 28 is closed and a valve 56 is opened to deliver the refrigerant through the tap 40 to the common heat exchanger 31.

In addition, a valve 50 is placed on an economizer return line 34 delivering refrigerant back to the compressor 22 at some intermediate (between suction and discharge) pressure. Another valve 52 is placed on a bypass line 38 communicating refrigerant flowing in the return line 34 back to a point 44 and then returning it through a suction line 45 to the suction port of the compressor 22.

The refrigerant system can operate in a conventional non-economized mode, and without a liquid-suction heat exchanger function by closing the valves 46 and 56 and opening the valve 54. Also, at least one of the valves 50 or 52 has to be closed to prevent the refrigerant bypass flow from an intermediate compressor port back to suction. Refrigerant will then flow through a basic conventional cycle.

If an unloader function is desired, the valves 50, 52 and 54 are opened and the valves 46 and 56 are closed.

If an evaporator bypass function is desired, the valves 46, 54 and 56 are opened with the valves 50 and 52 are closed.

If an economizer function is desired, the valves 46, 50 and 54 are opened and the valves 52 and 56 are closed.

In case an unloader function is desired in the economized mode of operation, the valves 46, 50, 52 and 54 are opened and the valve 56 is closed.

If instead of an economizer function, a liquid-suction heat exchanger function is desired, the valves 46, 50 and 54 are closed and the valves 52 and 56 are opened. Refrigerant will now flow through the tap line 40, into the supply line 48, through the common heat exchanger 31, and will subcool the refrigerant in a main line 36. That refrigerant will pass back through the return line 34, through the bypass line 38, and return to the point 44 in the suction line 45 leading back to the suction port of the compressor 22.

The unloader function can also be achieved in combination with the liquid-suction heat exchanger function by opening the valve 50.

The above embodiment utilizes a single common heat exchanger to provide the function of either an economizer heat exchanger, or a liquid-suction heat exchanger. Thus, more flexibility is given to the refrigerant system designer, without the requirement of two distinct auxiliary heat exchangers. Of course, an appropriate control with the appropriate programming to actuate the proper flow control devices to achieve desired operating conditions in a desired mode of operation is to be included.

Also, a combination of the operating modes described above can be executed by opening and closing appropriate flow control devices. For instance, an evaporator bypass may be simultaneously provided with the economizer function, if desired. Furthermore, as known, the economizer tap can be located downstream of the heat exchanger 31 providing identical benefits to a system designer. It should also be pointed out that a function of two separate valves adjacent to a common piping junction can be substituted by a single multi-functional valve that can route the flow of refrigerant through the junction in the appropriate directions.

Figure 2C:
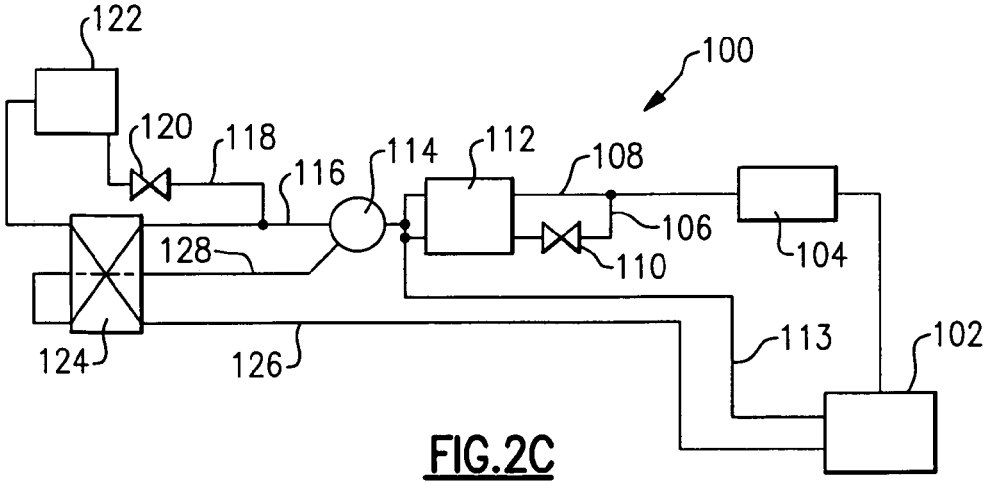
FIG. 2C shows a variation of the FIG. 2B schematic.
Figure 2A:
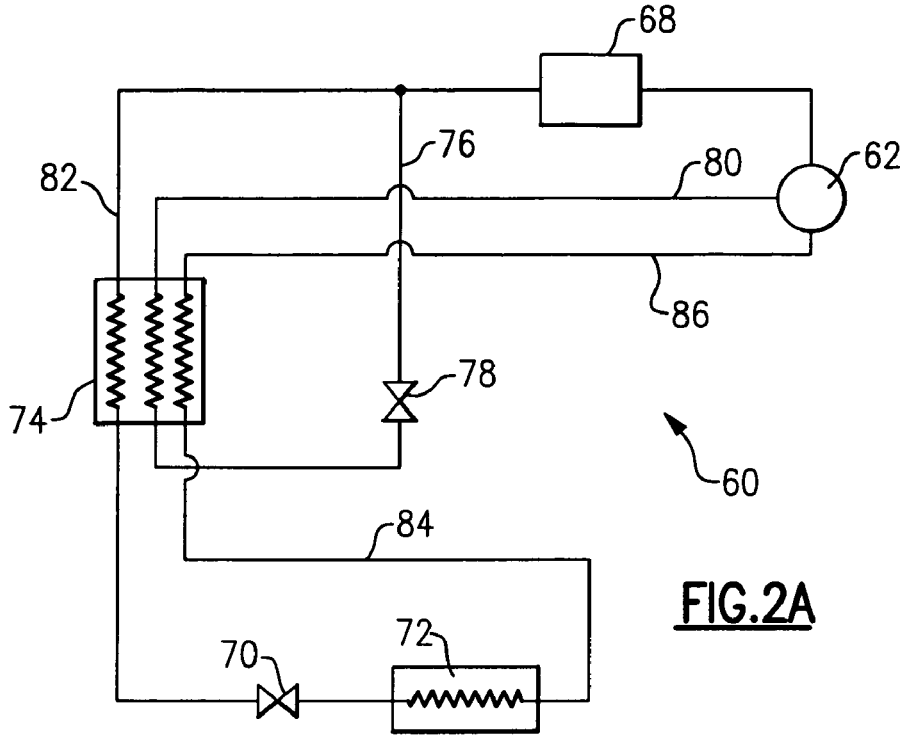
FIG. 2A is a second schematic of the present invention.

FIG. 2A shows another embodiment 60 with the economized compressor 62. Refrigerant downstream of the compressor 62 passes through a condenser 68, a main expansion device 70, and an evaporator 72. A common heat exchanger 74 receives refrigerant from an economizer circuit tap line 76 through an economizer expansion device 78. The tapped refrigerant would flow through an economizer circuit return line 80 back to the economizer port of the compressor 62 at some intermediate pressure. The main liquid refrigerant line 82 downstream of the condenser also passes through the common heat exchanger 74. A line 84 downstream of the evaporator 72 passes through the common heat exchanger 74 as well, and then back to a suction line 86 that returns refrigerant to the suction port of the compressor 62. This schematic selectively provides an economizer function by opening or closing the economizer expansion device 78. In case the economizer expansion device 78 is not equipped with a shutoff capability, a separate shutoff valve is needed. The liquid-suction heat exchanger function will always take place, as the line 84 is a dedicated line passing through the common heat exchanger 74. In the common three-stream heat exchanger 74, heat transfer interaction occurs between liquid refrigerant in the line 82, a two-phase refrigerant in the line 76 (when the valve 76 is open) and a vapor refrigerant in line 84. As a result, liquid refrigerant is subcooled and system performance is enhanced. Furthermore, the economizer function may be only activated when an additional performance boost is desired.

Figure 2B:
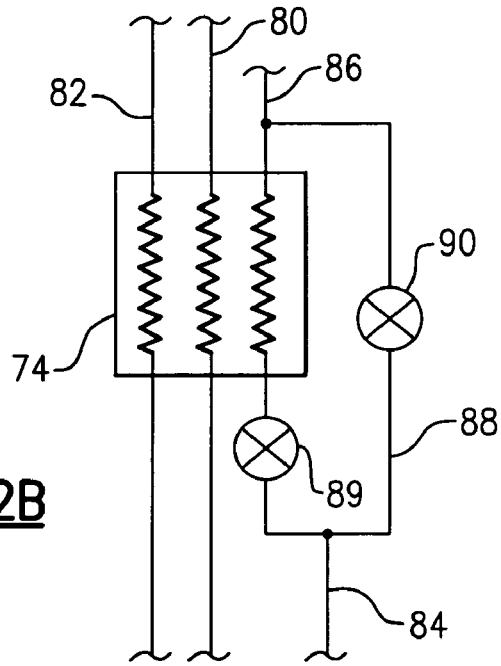
FIG. 2B shows an option that may be incorporated into the FIG. 2A schematic.

FIG. 2B shows an option wherein a valve 89 (when closed) forces vapor refrigerant flow through a bypass line 88 to the suction line 84. This causes the refrigerant to bypass the common heat exchanger 74 when the liquid-suction heat exchanger function is not desired. That is, when the liquid-suction heat exchanger function is desired, a valve 90 is closed and a valve 89 is opened. On the other hand, when the liquid-suction heat exchanger function is not desired, the valve 89 is closed and the valve 90 is opened. It should be understood that a function of the two valves 89 and 90 can be combined into a single three-way valve that would selectively route the refrigerant into the line 88 by-passing the common heat exchanger 74, or block the refrigerant from entering the line 88 to route it through the common heat exchanger 74.

Another embodiment 100 shown in FIG. 2C is a variation of the configuration presented in FIG. 2B. In this embodiment, an economizer function and a liquid-suction heat exchanger function are provided by separate units, 112 and 124 respectively, while a three-way valve 114 selectively routes the refrigerant through or around the liquid-suction heat exchanger 124.

An economized compressor 102 delivers refrigerant to a downstream condenser 104. A tap 106 from a main liquid refrigerant line 108 passes through an economizer expansion device 110, which is also utilized as a shut-off valve in this schematic. The refrigerant from both the tap 106 and main liquid refrigerant line 108 flows through the economizer heat exchanger 112. In fact, while the two are shown flowing in the same direction, in practice, it would be preferable if they were in a counter-flow relationship. If no economizer function is desired, then valve 110 is shut. The three-way valve 114 receives the refrigerant downstream of the economizer heat exchanger 112. The three-way valve 114 directs the refrigerant to a line 116, and then to a line 118 leading to a main expansion device 120, and an evaporator 122. The flow position of the three-way valve 114 for the line 116 is selected when no liquid-suction heat exchanger function is desired. Downstream of the evaporator 122, refrigerant passes through a liquid-suction heat exchanger 124, to a suction line 126, and then back to the compressor 102. Since there is no other refrigerant flow passing through the liquid-suction heat exchanger 124, no liquid-suction heat exchanger function is achieved when the valve 114 is in this position.

When a liquid-suction heat exchanger function is desired, the valve 114 directs the refrigerant into a line 128. The line 128 directs the refrigerant through the liquid-suction heat exchanger 124 for the heat transfer interaction with the refrigerant exiting the evaporator 122. The refrigerant having passed through the line 128, through the liquid-suction heat exchanger 124, then passes into the line 118, through the main expansion device 120, and then to the evaporator 122. As was mentioned above, the refrigerant downstream of the evaporator 122 flows through the liquid-suction heat exchanger 124 once again and then returns to the suction port of the compressor 102. As in previous embodiments, this schematic achieves the benefits of an economizer function and a liquid-suction heat exchanger function.

In all the embodiments, the economizer flow can be tapped downstream of the common/economizer heat exchanger, not altering any of the benefits of the invention. Also, it is well understood by a person ordinarily skilled in the art that a single economized compressor can be replaced by a compound compressor or a two-stage compression system that would provide the same benefits as described above.

The present invention provides a few schematics that would achieve the function of both a liquid-suction heat exchanger and an economizer heat exchanger with a single common heat exchanger. Obviously, a worker of ordinary skill in the art would recognize that many schematics would also be able to provide the function, as long as a single heat exchanger provides both functions, it would be within the scope of this invention.

What is claimed is:

1. A refrigerant system comprising:

a compressor, a condenser downstream of said compressor, an expansion device downstream of said condenser, and an evaporator downstream of said expansion device; and a common heat exchanger for providing an economizer circuit heat exchanger function and a liquid-suction heat exchanger function.

2. The refrigerant system as set forth in claim 1, wherein said common heat exchanger communicates with a main refrigerant flow from said condenser to said expansion device, and selectively communicates with a tapped refrigerant tapped from said main refrigerant flow, and passing through said common heat exchanger, said tapped refrigerant providing said economizer circuit function, and being returned to an intermediate compression point at said compressor, said common heat exchanger also receiving a suction refrigerant tapped downstream of said evaporator and being returned to a suction port on said compressor providing liquid-suction heat exchanger function.

3. The refrigerant system as set forth in claim 2, wherein a flow control device is placed on a line containing said tapped refrigerant intermediate to a line containing said main refrigerant and said common heat exchanger such that said economizer function may be selectively provided.

4. The refrigerant system as set forth in claim 2, wherein a flow control device is positioned on said suction refrigerant tap downstream of said evaporator and upstream of said common heat exchanger such that said liquid-suction heat exchanger function may be selectively provided.

5. The refrigerant system as set forth in claim 2, wherein said tapped refrigerant and said suction refrigerant flows can pass through said common heat exchanger simultaneously, and through separate flow lines.

6. The refrigerant system as set forth in claim 2, wherein said common heat exchanger includes a supply line that is selectively communicated to one of said tapped refrigerant and said suction refrigerant.

7. The refrigerant system as set forth in claim 6, wherein a system of flow control devices selectively communicates either said tapped refrigerant or said suction refrigerant to said supply line.

8. The refrigerant system as set forth in claim 7, wherein a first tap line tapped off of said main refrigerant flow line provides said tapped refrigerant and passes to said supply line, and a second tap line is tapped from a position downstream of said evaporator and provides said suction refrigerant and communicates to said supply line, a first flow control device positioned downstream of said second tap line, and a second flow control device positioned on said second tap line, a third flow control device positioned on said first tap line, and intermediate to said supply line and said main refrigerant flow line, and an intermediate pressure return line communicating refrigerant from said common heat exchanger back to an intermediate compression point in said compressor with a fourth flow control device, an unloader line selectively communicating said intermediate pressure return line back to a suction return line, with a fifth flow control device positioned on said unloader line.

9. The refrigerant system as set forth in claim 8, wherein said first flow control device is closed and said second flow control device is open with said third flow control device closed, said fourth flow control device closed, and said fifth flow control device open to provide said liquid-suction heat exchanger function.

10. The refrigerant system as set forth in claim 8, wherein said first flow control device is open, said second flow control device is closed, said fifth flow control device is closed, and said third and fourth flow control devices are open to provide said economizer heat exchanger function.

11. The refrigerant system as said forth in claim 2, wherein said common heat exchanger has a separate flow line to receive said tapped refrigerant and said suction refrigerant, such that both of said economizer heat exchanger function and said liquid-suction heat exchanger function can occur simultaneously.

12. The refrigerant system as set forth in claim 11, wherein said liquid-suction heat exchanger function occurs permanently.

13. The refrigerant system as set forth in claim 12, wherein a flow control device or system of flow control devices allows selective bypass of said common heat exchanger by said suction refrigerant.

14. A refrigerant system comprising:

a compressor, a condenser downstream of said compressor, an expansion device downstream of said condenser, and an evaporator downstream of said expansion device;

a liquid-suction heat exchanger for providing a liquid-suction heat exchanger function, said liquid-suction heat exchanger being positioned to receive refrigerant downstream of said evaporator, and to direct a refrigerant from a location downstream of said condenser to be cooled by said refrigerant downstream of said evaporator; and a flow control device for selectively providing refrigerant downstream of said condenser to said liquid-suction heat exchanger.

15. The refrigerant system as set forth in claim 14, wherein said liquid-suction heat exchanger also provides an economizer heat exchanger function by receiving refrigerant from a tap line downstream of said condenser.

16. The refrigerant system as set forth in claim 14, wherein a three-way valve directs refrigerant downstream of said condenser either directly to said expansion device and to said evaporator, or directly to said liquid-suction heat exchanger.

17. The refrigerant system as set forth in claim 16, wherein refrigerant passes from said evaporator downstream through said liquid-suction heat exchanger when said flow control device is in either position.

18. The refrigerant system as set forth in claim 14, wherein the economizer heat exchanger and a liquid-suction heat exchanger are separate heat exchangers.

* * * * *